US009079745B2

(12) United States Patent
Galindo Gonzalez et al.

(10) Patent No.: US 9,079,745 B2
(45) Date of Patent: Jul. 14, 2015

(54) PAY-OFF ASSEMBLY

(75) Inventors: Juan Alberto Galindo Gonzalez, Powder Springs, GA (US); William Allen Sewell, Franklin, GA (US); Frank Calhoun, Carrollton, GA (US); Laurentiu Dan Dragomir, Atlanta, GA (US); Myron Deese, Carrollton, GA (US)

(73) Assignee: Southwire Company, LLC, Carrollton, GA (US)

( * ) Notice: Subject to any disclaimer, the term of this patent is extended or adjusted under 35 U.S.C. 154(b) by 477 days.

(21) Appl. No.: 13/408,511

(22) Filed: Feb. 29, 2012

(65) Prior Publication Data

US 2012/0223179 A1 Sep. 6, 2012

Related U.S. Application Data

(60) Provisional application No. 61/447,903, filed on Mar. 1, 2011.

(51) Int. Cl.

| | |
|---|---|
| ***B65H 16/02*** | (2006.01) |
| ***B65H 49/32*** | (2006.01) |
| ***B65H 75/18*** | (2006.01) |

(52) U.S. Cl.

CPC ..... *B65H 49/32* (2013.01); *B65H 49/325* (2013.01); *B65H 75/185* (2013.01)

(58) Field of Classification Search

CPC ..... B65H 49/20; B65H 49/24; B65H 49/26; B65H 49/32; B65H 49/324; B65H 49/325; B65H 49/36; B65H 49/38

USPC ..... 242/403, 557, 598, 598.3, 598.4, 598.5, 242/599, 599.3

See application file for complete search history.

(56) References Cited

U.S. PATENT DOCUMENTS

| | | | |
|---|---|---|---|
| 1,888,761 | A | 11/1932 | Foyer |
| 1,982,642 | A | 12/1934 | Curok |

(Continued)

FOREIGN PATENT DOCUMENTS

| | | |
|---|---|---|
| CN | 202272591 | 6/2012 |
| EP | 0130473 | 1/1985 |

(Continued)

OTHER PUBLICATIONS

Product Advertisement and Description, www.greenlee.com, circa 2007.

(Continued)

*Primary Examiner* — Emmanuel M Marcelo
*Assistant Examiner* — Angela Caligiuri
(74) *Attorney, Agent, or Firm* — Hartman & Citrin LLC

(57) ABSTRACT

An improved pay-off assembly allowing cable loaded on a cable reel to be transported to an installation site and/or paid-off during a cable pull is described. The pay-off assembly may include one or more of lateral support braces that provide stability and strength to an A-frame structure supporting the cable reel; a reel lock assembly for securely holding the cable reel in place during transport and/or pay-off of the cable; an end cap assembly that prevents detachment from an arbor as the arbor and cable reel rotate during pay-off; a dog hole stop assembly that engages a "dog hole" in the cable reel to prevent the cable reel from rotating during transport; a braking system for controlling the rotational speed of the cable reel during pay-off; and a ground attachment assembly that allows an additional cable reel to be loaded for transport and/or pay-off of the cable.

26 Claims, 15 Drawing Sheets

(56) References Cited

U.S. PATENT DOCUMENTS

| | | | | | |
|---|---|---|---|---|---|
| 2,144,094 | A | * | 1/1939 | Wood | 242/118.4 |
| 2,755,066 | A | | 7/1956 | Mallasch | |
| 3,304,060 | A | | 2/1967 | Davenport | |
| 3,458,152 | A | * | 7/1969 | Barkley et al. | 242/422.4 |
| 3,583,743 | A | | 6/1971 | Newell | |
| 3,614,065 | A | | 10/1971 | Adamski | |
| 3,788,575 | A | | 1/1974 | Boettcher et al. | |
| 3,948,462 | A | | 4/1976 | Maillefer | |
| 4,030,704 | A | | 6/1977 | Beierle et al. | |
| 4,068,427 | A | | 1/1978 | Camardo | |
| 4,092,012 | A | | 5/1978 | Ishigami | |
| 4,098,468 | A | | 7/1978 | Skalleberg | |
| 4,194,702 | A | | 3/1980 | Ploeg | |
| 4,209,140 | A | | 6/1980 | Seibert | |
| 4,454,999 | A | | 6/1984 | Woodruff | |
| 4,502,390 | A | | 3/1985 | Shaw | |
| 4,583,713 | A | | 4/1986 | Fukura et al. | |
| 4,746,078 | A | | 5/1988 | Setzke | |
| 4,752,047 | A | | 6/1988 | Franks, Jr. | |
| 4,754,937 | A | | 7/1988 | Hoddinott et al. | |
| 4,789,108 | A | * | 12/1988 | Recalde | 242/388.7 |
| 4,899,945 | A | | 2/1990 | Jones | |
| 4,945,938 | A | * | 8/1990 | Ponsford et al. | 137/15.01 |
| 5,029,814 | A | | 7/1991 | Liegel et al. | |
| 5,123,602 | A | | 6/1992 | Skalleberg et al. | |
| 5,228,656 | A | * | 7/1993 | Sauber | 248/201 |
| 5,242,127 | A | | 9/1993 | Jaaskelainen | |
| 5,246,180 | A | | 9/1993 | Berry, III et al. | |
| 5,267,702 | A | | 12/1993 | Schumacher et al. | |
| 5,294,066 | A | | 3/1994 | Lacour | |
| 5,312,057 | A | | 5/1994 | Graham | |
| 5,332,166 | A | | 7/1994 | Kepes | |
| 5,467,969 | A | | 11/1995 | Kobayashi et al. | |
| 6,299,100 | B1 | | 10/2001 | Cloud | |
| 6,435,450 | B1 | * | 8/2002 | Shields et al. | 242/594.3 |
| 6,457,667 | B1 | | 10/2002 | Golightly et al. | |
| 6,481,661 | B1 | | 11/2002 | Lauhde | |
| 6,533,248 | B1 | * | 3/2003 | Schafer | 254/134.3 FT |
| 7,040,059 | B2 | | 5/2006 | Hodsdon et al. | |
| 7,077,368 | B1 | | 7/2006 | Karoly | |
| 7,658,345 | B2 | * | 2/2010 | Wells et al. | 242/577 |
| 7,721,664 | B2 | * | 5/2010 | Woolley | 112/314 |
| 7,823,861 | B2 | | 11/2010 | Krug | |
| 8,025,261 | B2 | | 9/2011 | Jordan et al. | |
| 8,276,858 | B1 | | 10/2012 | Jordan et al. | |
| 2008/0217491 | A1 | * | 9/2008 | Kossak | 248/74.1 |
| 2009/0196723 | A1 | * | 8/2009 | Smith et al. | 414/546 |
| 2011/0226885 | A1 | | 9/2011 | Fries et al. | |
| 2013/0168484 | A1 | * | 7/2013 | Novotny et al. | 242/419.8 |

FOREIGN PATENT DOCUMENTS

| | | |
|---|---|---|
| EP | 0628507 | 12/1994 |
| GB | 1456189 | 11/1976 |
| GB | 1514439 | 6/1978 |
| GB | 2236769 | 4/1991 |
| JP | H07124643 | 5/1995 |
| JP | 2010070338 | 4/2010 |
| JP | 2010143681 | 7/2010 |
| JP | 2010143682 | 7/2010 |
| SE | 466443 | 2/1992 |

OTHER PUBLICATIONS

U.S. Official Action dated Dec. 21, 2010 in U.S. Appl. No. 12/208,232.

U.S. Notice of Allowance dated May 12, 2011 in U.S. Appl. No. 12/208,232.

U.S. Official Action dated Jan. 12, 2012 in U.S. Appl. No. 13/230,016.

* cited by examiner

PAY-OFF ASSEMBLY

CROSS-REFERENCE TO RELATED APPLICATION

This application claims the benefit of U.S. Provisional Patent Application No. 61/447,903 filed on Mar. 1, 2011, and entitled "Improved Pay-off Assembly," which is expressly incorporated herein by this reference in its entirety.

BACKGROUND

Cabling comprising one or more large gauge wires or conductors is an integral part of many systems, including electrical and power systems. The installation of such cabling typically involves pulling the conductors in parallel through pipe or conduit or from pole to pole over long distances. The conductors are typically delivered to the site of the cable pull on large cable reels or spools, each cable reel potentially containing multiple conductors "paralleled" on the reel. Because of the length and size of the conductors required for such installations, the cable reels may be very large and weigh many hundreds or thousands of pounds.

The cable reels are typically delivered to the installation site on flatbed trucks or trailers and may be unloaded and moved into position for the installation by a crane or a forklift truck. To facilitate installation of the cabling, the cable reel is mounted on a reel stand or other platform such that the cable reel may be rotated about an axis of rotation, allowing the conductors to be pulled from the reel, or "paid off," during the cable pull. Handling of the large cable reel and loading of the reel into the reel stand may be difficult at the installation site, and could result in damage to the conductors loaded on the cable reel. Additionally, use of an inadequate reel stand could result in damage or injury if the large cable reel were to become disengaged from the reel stand during the installation due to the relatively high forces that may be required to pull the large gauge conductors over the lengths required.

It is with respect to these considerations and others that the disclosure made herein is presented.

SUMMARY

It should be appreciated that this Summary is provided to introduce a selection of concepts in a simplified form that are further described below in the Detailed Description. This Summary is not intended for use in limiting the scope of the claimed subject matter.

An improved pay-off assembly allowing cable, conductors, or wire loaded on a cable reel to be transported to an installation site and paid-off during a cable pull is described herein. According to some embodiments, the pay-off assembly provides a means to easily lift and transport the cable reel via a forklift, flatbed truck, or trailer. In additional embodiments, the pay-off assembly includes one or more lateral support braces that prevent an A-frame structure supporting the cable reel from spreading or collapsing under the weight of the cable reel and cable. In additional embodiments, the pay-off assembly includes a reel lock assembly that is easy to open and close under load and that holds an arbor assembly with the cable reel securely in place during transport of the reel and pay-off of the cable.

According to further embodiments, an arbor assembly of the pay-off assembly includes an end cap assembly with a hand-wheel that allows the end cap to be attached to the arbor assembly by hand and that prevents the end cap from detaching as the arbor and cable reel rotate during pay-off. In additional embodiments, the pay-off assembly includes a dog hole arm that may be extended from the frame and pivots around a support at one end such that a pin on the other end may engage a "dog hole" in the cable reel to prevent the cable reel from rotating during transport. In additional embodiments, the pay-off assembly includes a ground attachment assembly that allows an additional cable reel to be loaded for transport to the installation site and pay-off of the cable during the cable pull. In additional embodiments, the pay-off assembly includes a braking system that may be utilized to control the speed of rotation of the cable reel during pay-off of the cable in order to keep a requisite amount of tension in the cable during the cable pull.

Other apparatus, systems, and methods according to embodiments will be or become apparent to one with skill in the art upon review of the following drawings and Detailed Description. It is intended that all such additional apparatus, systems, and/or methods be included within this description, be within the scope of the present invention, and be protected by the accompanying claims.

DETAILED DESCRIPTION

Figure 1:
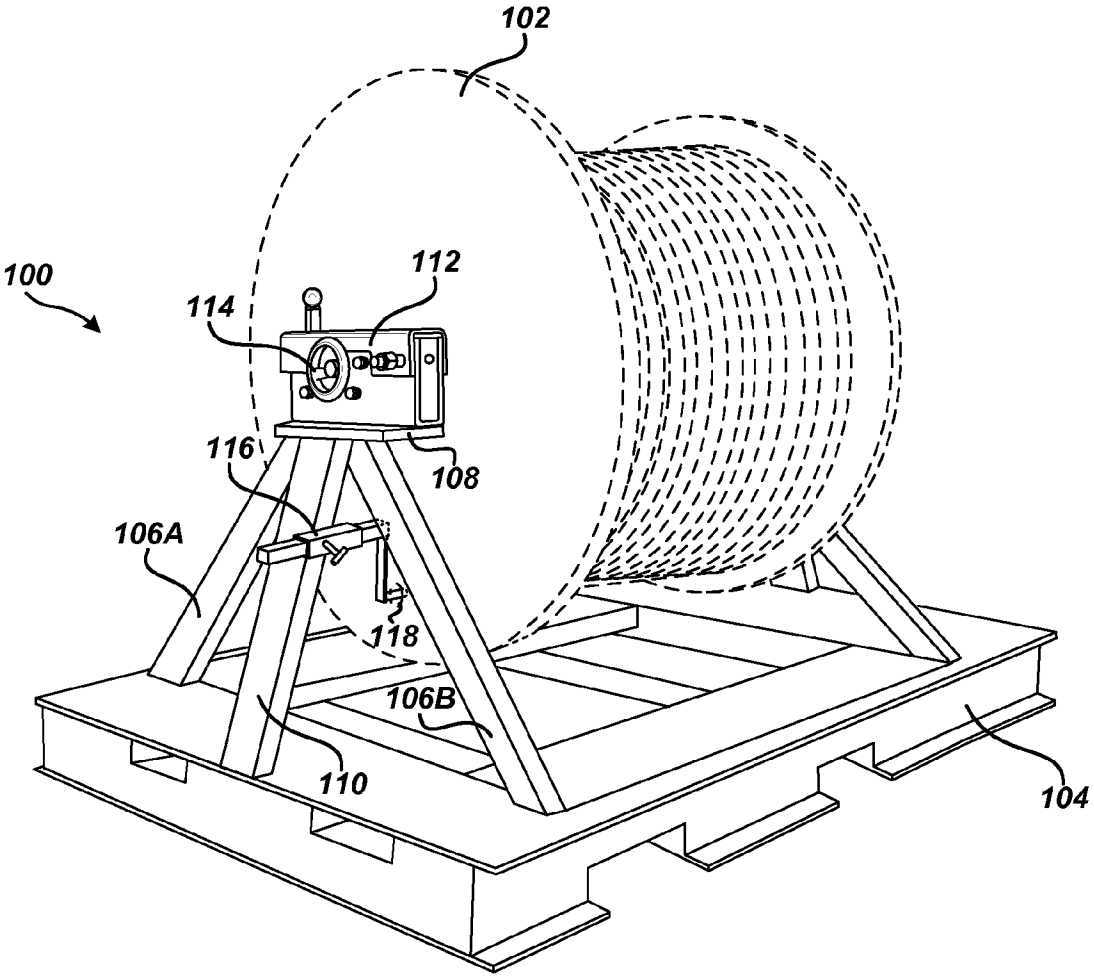
FIG. 1 is a perspective view of an illustrative pay-off assembly holding a cable reel, according to embodiments.

The following detailed description is directed to an improved pay-off assembly allowing cable, conductors, or wire loaded on a cable reel to be transported to an installation site and paid-off during a cable pull, for example. In the following detailed description, references are made to the accompanying drawings that form a part hereof, and that show by way of illustration specific embodiments or examples. The drawings are not drawn to scale, and some aspects of particular elements may be omitted in the various views to clarify the illustration of the features being described. Accordingly, the dimensions or proportions of particular elements, or the relationships between those different elements, as shown in the drawings are chosen only for convenience of description, but do not limit possible implementations of this disclosure. Like numerals represent like elements throughout the several figures.

FIG. 1 shows an illustrative pay-off assembly 100 holding a cable reel 102 or spool, according to the embodiments described herein. The pay-off assembly 100 comprises a base 104 providing support for the pay-off assembly 100 as well as a means to lift and transport the pay-off assembly 100 and loaded cable reel 102, via forklift, flatbed truck, or trailer, for example. The cable reel 102 is supported in the pay-off assembly 100 by an A-frame structure comprising a pair of longitudinal braces 106A, 106B (also referred to herein as longitudinal brace 106 or longitudinal braces 106) rising from the base 104 and joined at a top plate 108 near each end of the pay-off assembly 100. According to some embodiments, the pay-off assembly 100 also includes one or more lateral support braces 110 that prevent the A-frame structure from spreading or collapsing under the weight of the cable reel 102 and cable.

In some embodiments, the pay-off assembly 100 includes reel lock assemblies 112 that are easy to open and close while under load and that hold an arbor assembly (not shown) within the cable reel 102 securely in place during transport of the cable reel 102 and pay-off of the cable. In further embodiments, the pay-off assembly 100 also includes an end cap assembly 114 with a hand-wheel that allows an end cap to be attached to the arbor assembly by hand and that prevents the end cap from detaching as the arbor rotates during rotation of the cable reel 102 and pay-off of the cable. In some embodiments, the pay-off assembly 100 also includes a dog hole stop assembly 116 that may be extended from the A-frame structure and positioned such that a pin on one end of the dog hole stop assembly 116 engages an aperture, or "dog hole" 118, in the cable reel 102 to prevent the cable reel 102 from rotating during transport. Each of these and additional features of the pay-off assembly 100 will be described in more detail below in regard to FIGS. 2-15 and the following description.

Figure 2:
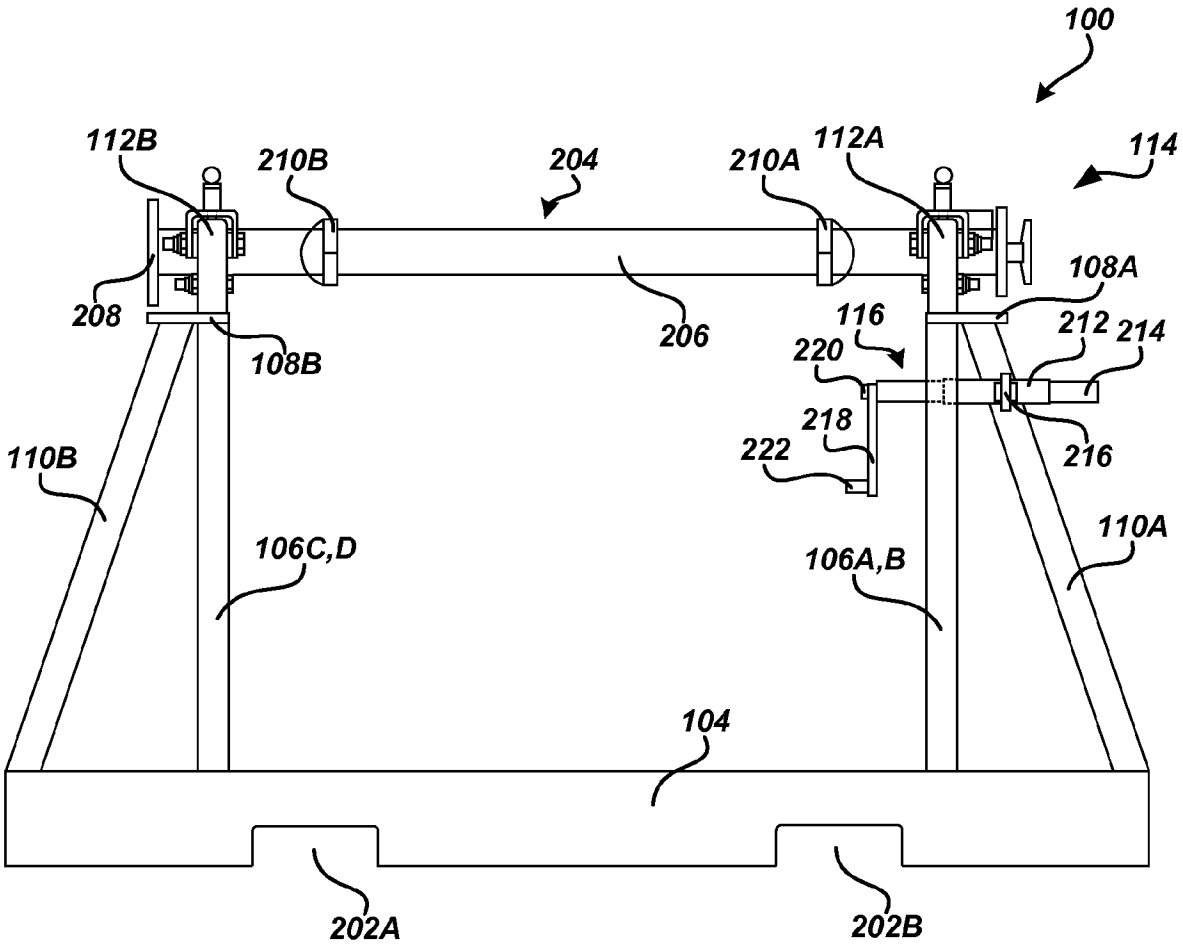
FIG. 2 is a side view of the illustrative pay-off assembly showing additional details of the described elements, according to embodiments.

FIG. 2 shows further details regarding the illustrative pay-off assembly 100, including the base 104 and A-frame structure. According to embodiments, the base 104 is designed to hold the weight of the A-frame structure and the cable reel 102 or spool with cable, and to be lifted and transported by a conventional forklift truck. According to some embodiments, the base 104 may include a number of indentations or fork pocket channels 202A, 202B positioned to allow for the pay-off assembly 100 to be easily lifted by the forklift truck. In further embodiments, the base 104 of the pay-off assembly 100 is sized such that it may fit in a small bed truck or trailer. For example, the base 104 may measure equal to or less than 48" wide by 48" deep such that the pay-off assembly 100 can be set in the bed of a conventional pick-up truck. Alternatively, the base 104 may be sized larger in order to support larger cable reels or spools.

The A-frame structure is attached to the base 104 and comprises two pairs of longitudinal braces 106A and 106B, 106C and 106D (also referred to herein generally as longitudinal braces 106) and a lateral support brace 110A, 110B (also referred to herein generally as lateral brace 110 or lateral braces 110) at each end of the base 104. The longitudinal braces 106A and 106B, 106C and 106D, and respective lateral support braces 110A, 110B may be welded or otherwise attached at a bottom to the base 104 and at a top to a top plate 108A, 108B (also referred to herein generally as top plate 108 or top plates 108). The lateral support braces 110 may provide additional support and prevent the longitudinal braces 106 from spreading under the weight of the cable reel 102 and cable and potentially causing the pay-off assembly 100 to collapse. In one embodiment, the lateral support braces 110 may extend diagonally outward from the top plate 108 towards the outer edge of the base 104, as shown in FIG. 2, in order to better counteract outward pressure on the A-frame structure from the weight of the cable reel 102 and cable, when loaded. Alternatively, the lateral support braces 110 may be vertical. It will be appreciated that the base 104, longitudinal braces 106, lateral support braces 110, and top plates 108 may be fabricated from any combination of tubular members, I-beams, channels, angles, plates, and the like of any size or dimension and made from steel, aluminum, plastic, composite, or any other suitable material or combination of materials.

A reel lock assembly 112A, 112B (also referred to herein generally as reel lock assembly 112 or reel lock assemblies 112) may be welded or otherwise attached to one or both of the top plates 108A, 108B, according to embodiments. As will be illustrated below, the reel lock assemblies 112 are easy to open and close while under load and hold an arbor assembly 204 with the cable reel 102 securely in place during transport of the cable reel 102. In addition, the arbor assembly 204 is allowed to rotate freely within the reel lock assemblies 112 during pay-off of the cable, as will be described in more detail below in regard to FIG. 8. According to embodiments, the arbor assembly 204 may include an arbor tube 206 with an end plate 208 attached to one end and the end cap assembly 114 at the other. As will be described below in regard to FIG. 5, the end cap assembly 114 includes a hand-wheel that allows the end cap assembly 114 to be removed from the arbor assembly 204 so that the arbor tube 206 may be passed through an arbor hole of the cable reel 102, and then reattached by hand in such a way to prevent the end cap assembly 114 from detaching from the arbor assembly 204 as the cable reel 102 and arbor tube 206 rotate during pay-off. In some embodiments, the arbor assembly 204 further includes a pair of shaft collars 210A, 210B (also referred to herein generally as shaft collar 210 or shaft collars 210) to prevent lateral movement of the cable reel 102 on the arbor assembly 204, as will be described in more detail below in regard to FIG. 6.

The dog hole stop assembly 116 is further shown in more detail in FIG. 2. According to embodiments, the dog hole stop assembly 116 comprises a dog tube holder 212. The dog tube holder 212 may be welded or otherwise attached to the lateral support brace 110A or one of the longitudinal braces 106A and 106B at one end of the pay-off assembly 100. The dog hole stop assembly 116 further comprises a dog hole tube 214 that slidedly-engages the dog tube holder 212 such that the dog hole tube 214 may be extended horizontally towards and away from the cable reel 102 when loaded into the pay-off assembly 100. A threaded T-handle bolt 216 may pass through a complementary-threaded aperture in the wall of the dog tube holder 212 so that an end of the T-handle bolt 216 engages a surface of the dog hole tube 214. The T-handle bolt 216 may be loosened to allow the dog hole tube 214 to slide through the dog tube holder 212 and then tightened to hold the dog hole tube 214 in position.

The dog hole stop assembly 116 further comprises a dog hole arm 218. In one embodiment, the dog hole arm 218 is attached to an end of the dog hole tube 214 by passing a socket head shoulder screw 220 or other fastener through an aperture at a proximal end of the dog hole arm 218 to engage a complementary-threaded aperture in a plug in the end of the dog hole tube 214. In this way the dog hole arm 218 may pivot freely about its proximal end at the dog hole tube 214, allowing a pin 222 attached to the distal end of the dog hole arm 218 to be positioned to engage dog holes 118 in various locations on various sizes of cable reels 102. The pin 222 attached to the distal end of the dog hole arm 218 may be sized such to securely engage a typical dog hole 118 in the cable reel 102 to prevent the cable reel 102 from rotating while in transport.

Figure 3:
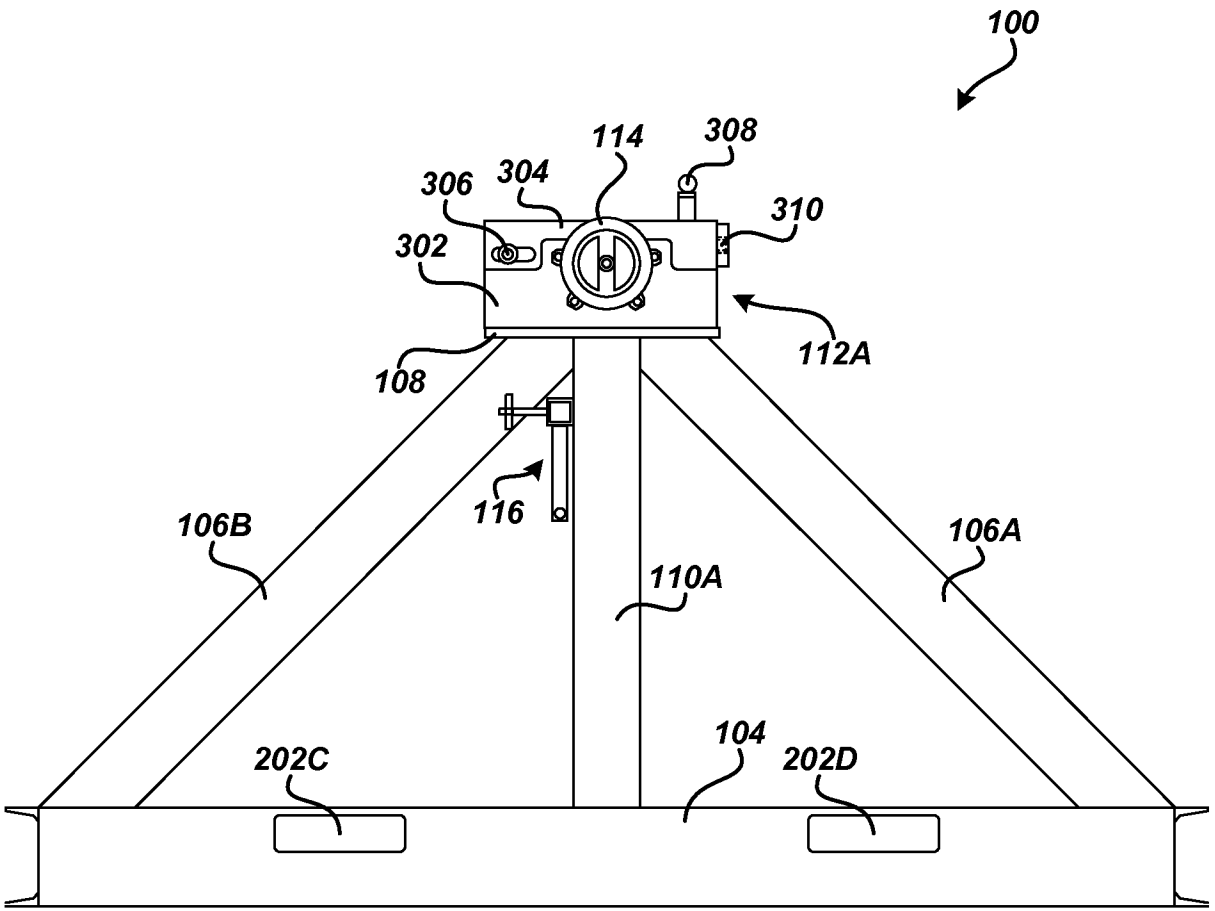
FIG. 3 is an end view of the illustrative pay-off assembly showing additional details of the described elements, according to embodiments.

FIG. 3 shows further details regarding the illustrative pay-off assembly 100, including the base 104, longitudinal braces 106A and 106B, top plate 108, lateral support brace 110A, reel lock assembly 112A, end cap assembly 114, and dog hole stop assembly 116. In some embodiments, the base 104 may include additional fork pocket channels 202C, 202D that provide for the pay-off assembly 100 to be easily lifted by the forklift truck both from the end and from the side.

According to embodiments, the reel lock assembly 112A comprises a reel lock bottom 302 and a reel lock top 304. The reel lock bottom 302 may be welded or otherwise attached to the top plate 108, as further shown in FIG. 3. According to some embodiments, the reel lock top 304 is attached to the reel lock bottom 302 by a bolt 306 or other fastener that acts as a hinge, allowing the reel lock top 304 to be opened for inserting the arbor tube 206 and then closed to hold the arbor tube 206 securely in place, as will be described below in more detail in regard to FIGS. 7-9C. In further embodiments, a pin 310 on the reel lock bottom 302 and/or a pull-pin 308 on the reel lock top 304 holds the reel lock assembly 112A securely closed, thus preventing the cable reel 102 from disengaging from the pay-off assembly 100 during transport or pay-off of the cable.

Figure 4:
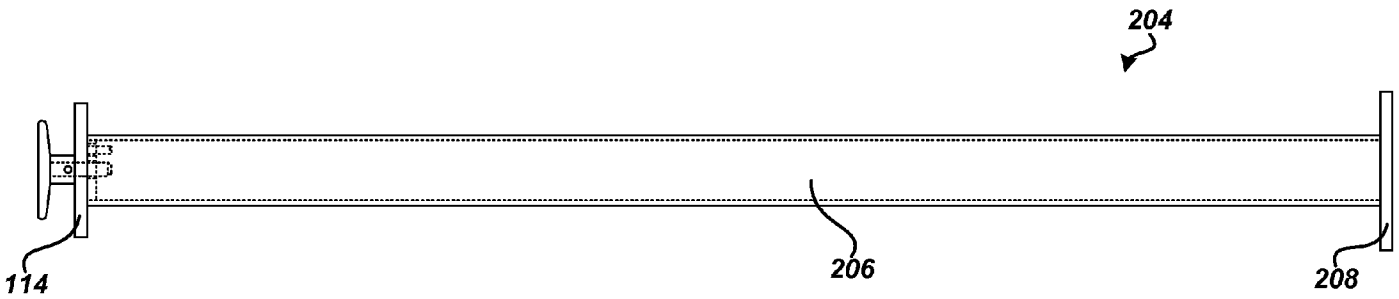
FIG. 4 is a plan view of an illustrative arbor assembly including an end cap assembly with hand-wheel, according to embodiments.

FIG. 4 shows details of an illustrative arbor assembly 204, including the end cap assembly 114. As described above in regard to FIG. 2, the arbor assembly 204 may include the fixed end plate 208 at one end of the arbor tube 206 and the removable end cap assembly 114 at the other end. According to embodiments, the arbor tube 206 passes through an arbor hole in the cable reel 102 or spool and rests in the reel lock bottom 302, thus supporting the cable reel 102 in the pay-off assembly 100. The reel lock bottom 302 may include a number of track rollers that allow the arbor tube 206 to rotate freely within the reel lock assembly 112A during pay-off of the cable from the cable reel 102, as will be described in more detail in regard to FIG. 8. The arbor tube 206 may be made of tubular steel or other material suitable to hold the weight of the cable reel 102 and cable when loaded in the pay-off assembly 100. The end plate 208 may be made of plate steel or other suitable material, for example.

Figure 5:
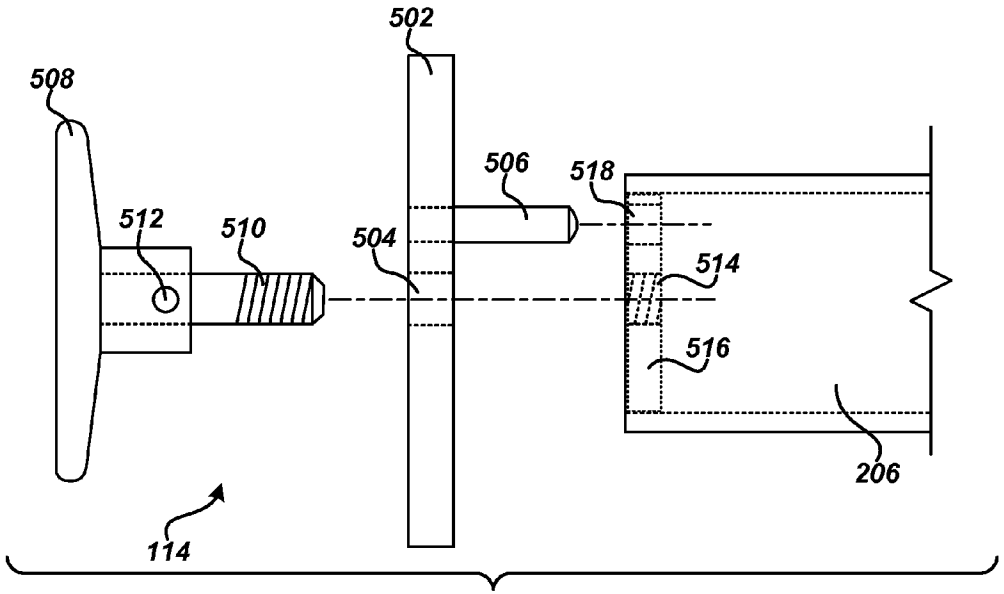
FIG. 5 is an explosion view showing additional details of the end cap assembly with hand-wheel, according to embodiments.

The end cap assembly 114 includes a hand-wheel that allows the end-cap assembly 114 to be removed from the arbor assembly 204 so that the arbor tube 206 may be passed through the arbor hole of the cable reel 102, and then reattached by hand in such a way to prevent the end cap assembly 114 from detaching from the arbor assembly 204 as the cable reel 102 and arbor tube 206 rotate during pay-off of the cable. FIG. 5 shows additional details regarding the end cap assembly 114. In some embodiments, the end cap assembly 114 comprises an end cap 502 with a center aperture 504 and an attached pin 506 distal to the center aperture 504. The hand-wheel 508 includes a threaded bolt extension 510 that may be attached to the hand-wheel 508 by a spring pin 512, set screw, or other attachment means. To attach the end cap assembly 114 to the end of the arbor tube 206, the threaded bolt extension 510 is passed through the center aperture 504 of the end plate 502 and engages a complementary-threaded aperture 514 in a plug 516 in the end of the arbor tube 206. The hand-wheel 508 may then be turned to hand-tighten the end cap 502 onto the end of the arbor tube 206. In addition, the attached pin 506 attached to the end cap 502 engages a corresponding aperture 518 in the plug 516, such that the end cap 502 will rotate with the arbor tube 206 as the arbor tube 206 rotates during pay-off. This prevents the end cap 502 and/or hand-wheel 508 from rotating counter to the arbor assembly 204 and becoming disengaged during pay-off of the cable.

Figure 6:
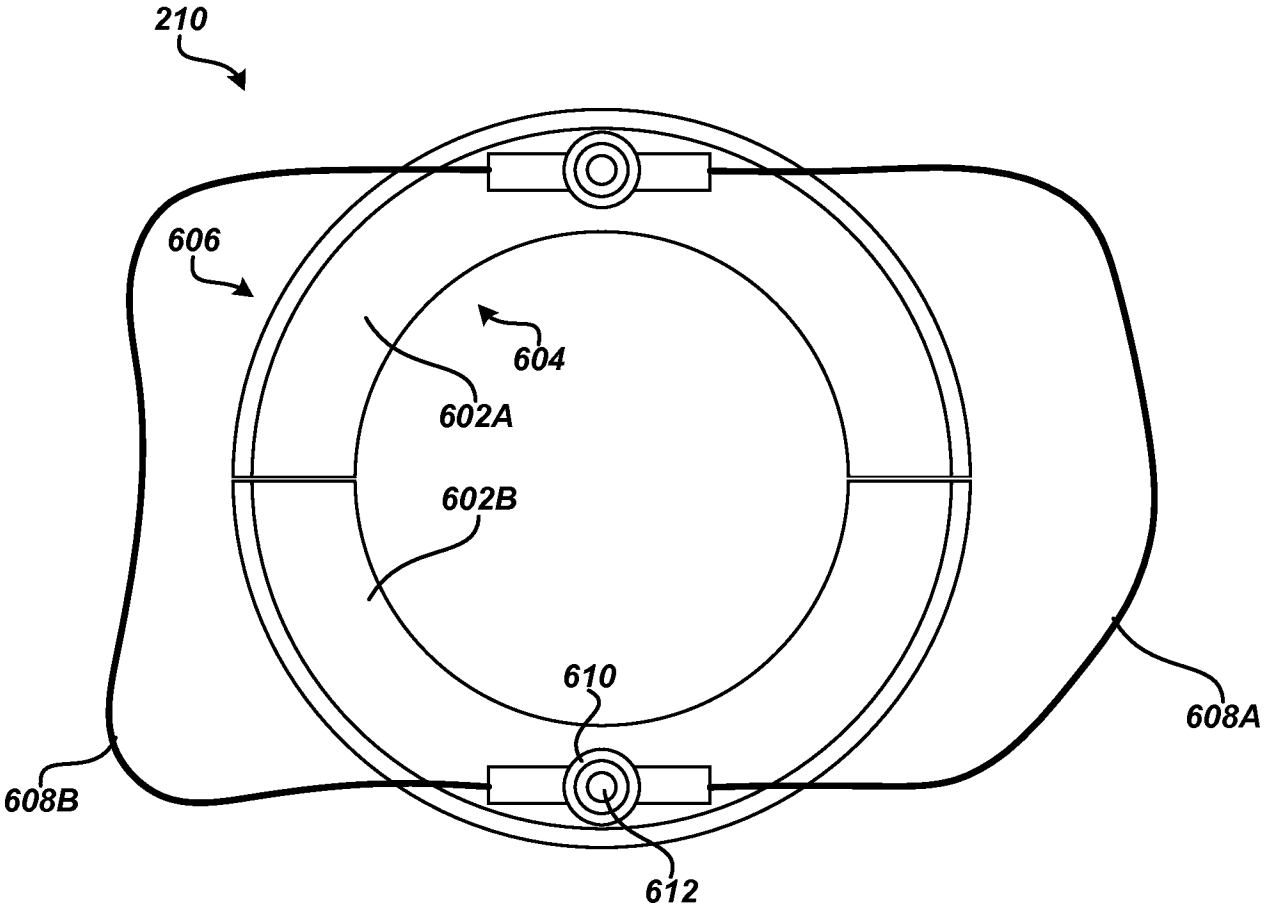
FIG. 6 is a side view of an illustrative shaft collar, according to embodiments.

FIG. 6 shows additional details regarding an illustrative shaft collar 210. As described above in regard to FIG. 2, the arbor assembly 204 may further include a pair of shaft collars 210A, 210B to prevent lateral movement on the cable reel 102 along the arbor tube 206. According to embodiments, each shaft collar 210 comprises two semi-circular halves 602A and 602B so that the shaft collar 210 can be split to allow the shaft collar 210 to be slid onto the arbor tube 206 and then clamped or bolted together into position. The semi-circular halves 602A and 602B may be stamped from plate steel or formed by some other means. Each semi-circular half 602A, 602B has an inner diameter 604 designed to allow the shaft collar 210 to engage the surface of the arbor tube 206, and an outer diameter 606 designed to be larger than the arbor hole of the cable reel 102 and to prevent lateral movement of the cable reel 102 along the arbor tube 206. In further embodiments, the two semi-circular halves 602A and 602B of the shaft collar 210 may be loosely held together by one or more lanyards 608A, 608B to prevent the semi-circular halves 602A, 602B from becoming separated and/or dropped while being placed into position on the arbor tube 206. The lanyards 608A, 608B may be made of metal wire or nylon rope, and may include eyelets 610 at either end, allowing the lanyards 608A, 608B to be connected to the semi-circular halves 602A, 602B by socket head cap screws 612 or other fasteners, for example.

Figure 7:
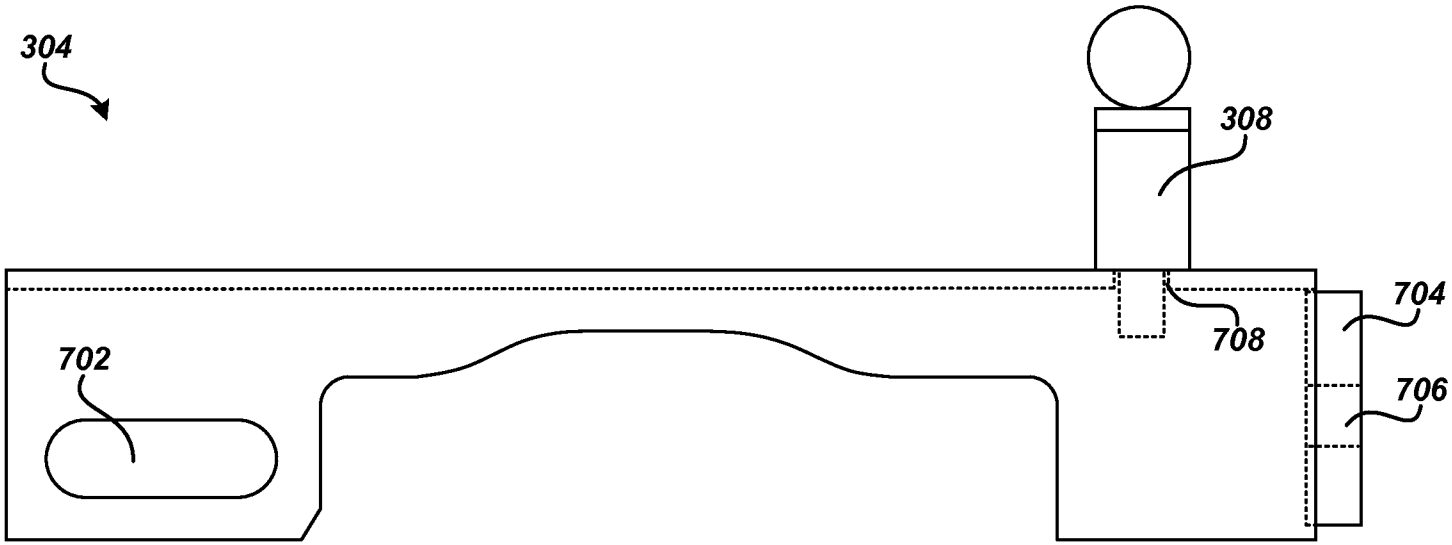
FIG. 7 is a side view of an illustrative reel lock top of a reel lock assembly, according to embodiments.

FIG. 7 shows details of an illustrative reel lock top 304 of the reel lock assembly 112. In some embodiments, the reel lock top 304 may be formed and/or machined from steel plate, aluminum plate, or other suitable material and may be open at the bottom to receive the reel lock bottom 302 when the reel lock assembly 112 is closed. The reel lock top 304 may include a slot 702 at a proximal end and an end plate 704 or plug welded or otherwise attached at a distal end. The end plate 704 further includes an aperture 706 for engaging the pin 310 on the reel lock bottom 302, as will be described below.

In some embodiments, the reel lock top 304 is attached to the reel lock bottom 302 by passing the bolt 306 or other fastener through the slot 702 on the proximal end and through a corresponding aperture on the same end of the reel lock bottom 302, as will be described below. The bolt 306 or other fastener is secured in place by an appropriate nut or cotter-pin. Attaching the reel lock top 304 to the reel lock bottom 302 in this manner allows the reel lock top 304 to both rotate about the proximal end as well as to slide laterally such that the aperture 706 through the end plate 704 at the distal end may engage the pin 310 on the reel lock bottom 302, as will be described below in regard to FIGS. 9A-9C. In further embodiments, the reel lock top 304 includes the pull-pin 308 attached to a top surface and extending through an aperture 708 in the top of the reel lock top 302. As will be described further below, the pull-pin 308 may engage a corresponding aperture through the top of the reel lock bottom 302 when the reel lock assembly 112 is closed to prevent the reel lock top 304 from sliding laterally along the reel lock bottom 302 and becoming disengaged from the pin 310.

Figure 8:
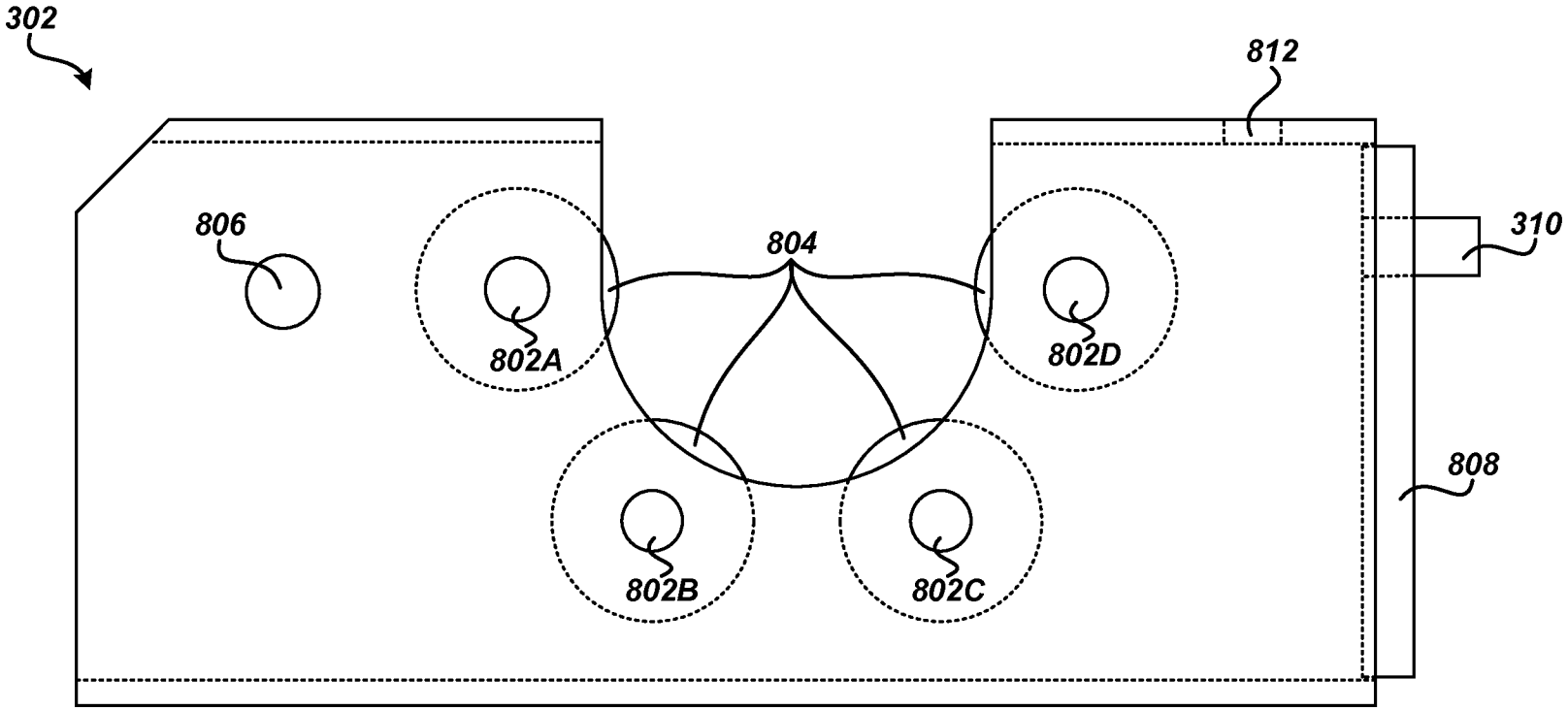
FIG. 8 is a side view of an illustrative reel lock bottom of a reel lock assembly, according to embodiments.

FIG. 8 shows details of an illustrative reel lock bottom 302 of the reel lock assembly 112. In some embodiments, the reel lock bottom 302 may be fabricated and machined from tubular steel, aluminum, or other suitable material. According to some embodiments, the reel lock bottom 302 assembly includes a number of apertures 802A-802D for mounting track rollers 804 or other bearings to receive the arbor tube 206 of the arbor assembly 204 and allow the arbor tube 206 to rotate freely during pay-off of the cable from the cable reel 102. Each track roller 804 may be attached by passing a bolt (not shown) or other fastener through the aperture 802A-802D on a front side of the reel lock bottom 302, through the track roller 804, and then through a corresponding aperture on the back side of the reel lock bottom 302. The bolt or other fastener may be secured in place by an appropriate nut or cotter-pin, for example.

In further embodiments, the reel lock bottom 302 includes an aperture 806 at one end for attaching the reel lock top 304 using the bolt 306, as described above in regard to FIG. 7. The reel lock bottom 302 may also include an end plate 808 or plug with the pin 310 at the other end for engaging the corresponding aperture 706 through the end plate 704 at the distal end of the reel lock top 304. When the aperture 706 through the end plate 704 at the distal end of the reel lock top 304 engages the pin 310 on the reel lock bottom 302, the arbor tube 206 is locked into place in the reel lock assembly 112, thus preventing the cable reel 102 from disengaging from the pay-off assembly 100 during transport or pay-off of the cable. In addition, the reel lock bottom 302 may also include an aperture 812 through the top surface for engaging the pull-pin 308 through the top of the reel lock top 304 to prevent the reel lock top 304 from sliding laterally once the arbor tube 206 is locked into place in the reel lock assembly 112.

Figure 9A:
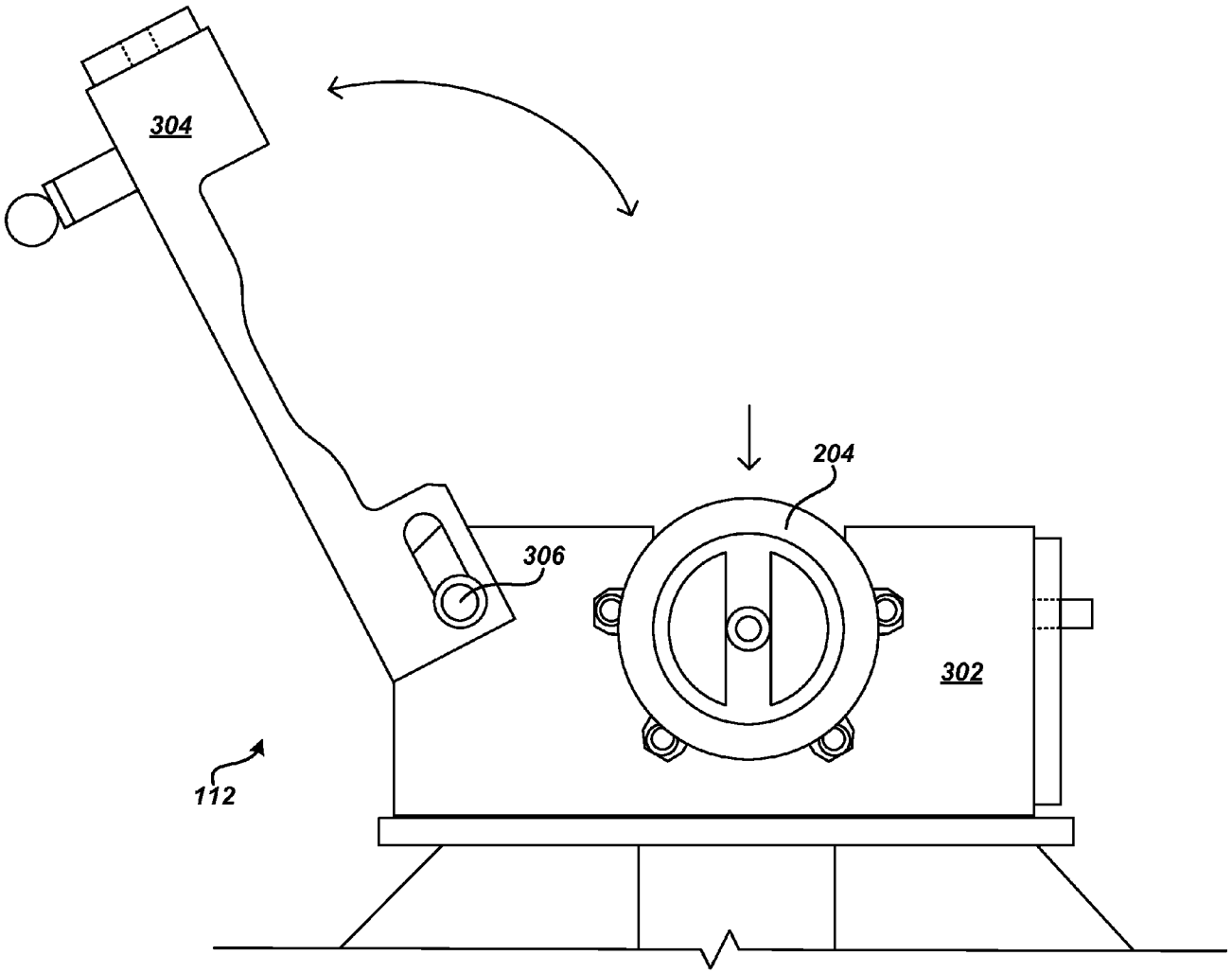
FIGS. 9A-9C are side views showing details of the operation of an illustrative reel lock assembly, according to embodiments.
Figure 9B:
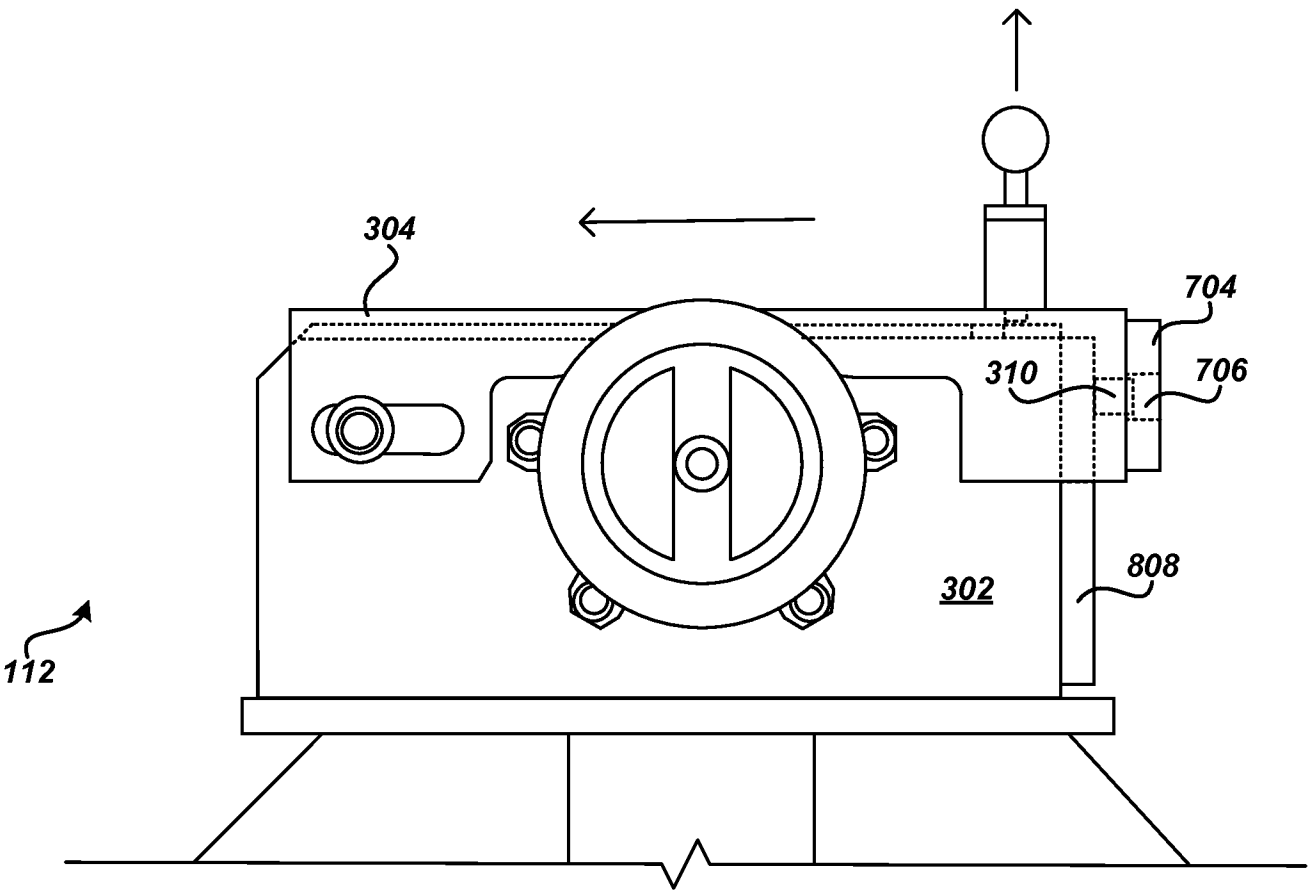
Figure 9C:
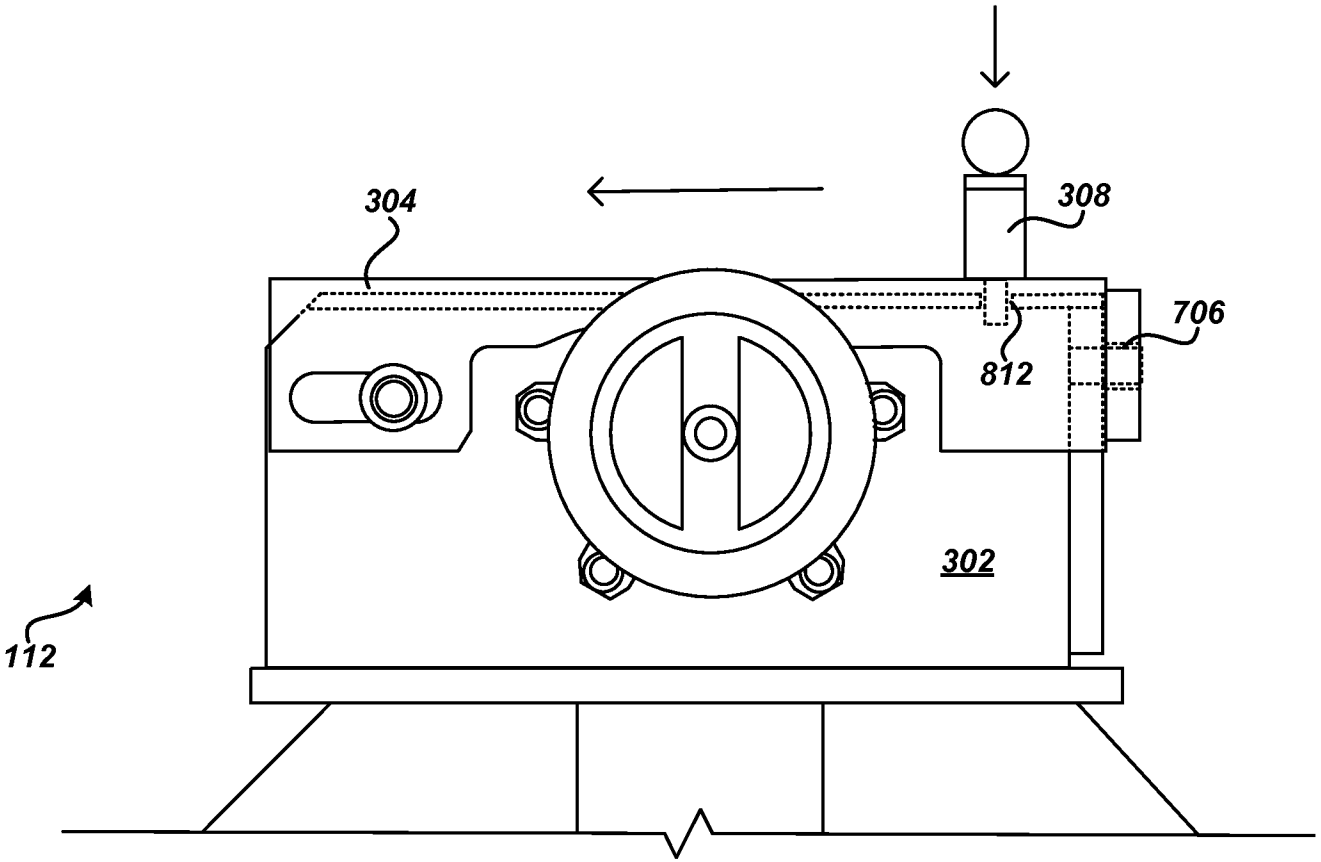

FIGS. 9A-9C show additional details regarding the operation of the reel lock assembly 112 of the pay-off assembly 100, according to some embodiments. As may be seen in FIG. 9A, the reel lock top 304 may pivot around the bolt 306 through the proximal end in order to open the reel lock assembly 112 and allow the arbor assembly 204 to be placed into the reel lock assembly 112 such that the arbor tube 206 engages the track rollers 804 of the reel lock bottom 302. Once the arbor assembly 204 is in place, the reel lock top 304 is pivoted closed, as shown in FIG. 9B. Next, the reel lock top 304 is slid laterally towards the proximal end such that the aperture 706 through the end plate 704 at the distal end engages the corresponding pin 310 on the end plate 808 of the reel lock bottom 302. Further, as shown in FIG. 9C, when the reel lock top 304 is slid to the point where the aperture 706 at the distal end fully engages the pin 310, the pull-pin 308 at the top of the reel lock top 304 may snap into the corresponding aperture 812 on the top surface of the reel lock bottom 302, thus latching the reel lock assembly 112 closed and securing the arbor assembly 204 in place in the reel lock assembly 112.

Figure 10:
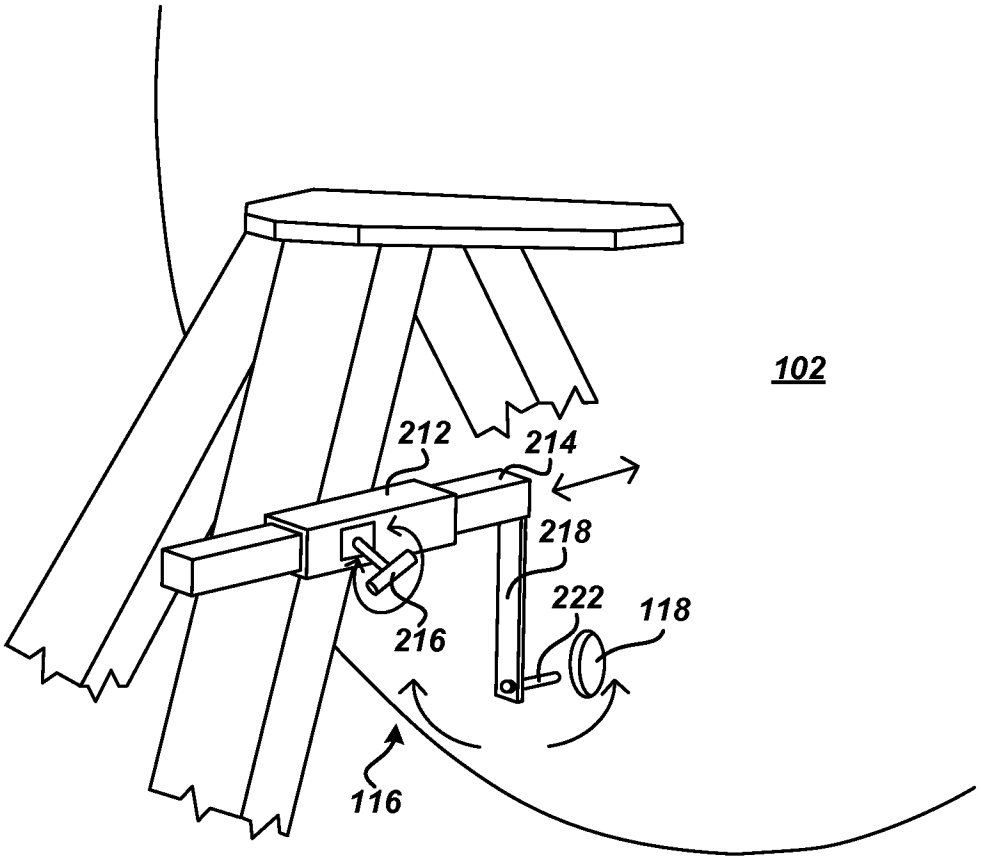
FIG. 10 is a perspective view showing details of the operation of an illustrative dog hole stop assembly, according to embodiments.

FIG. 10 shows further details regarding the operation of the dog hole stop assembly 116 of the pay-off assembly 100, according to some embodiments. As described above in regard to FIG. 2, the dog hole tube 214 may be extended horizontally towards the cable reel 102 by sliding the dog hole tube 214 through the dog tube holder 212. The dog hole arm 218 may pivot about its proximal end at the dog hole tube 214 such that the pin 222 attached to the distal end of the dog hole arm 218 is positioned to engage the dog hole 118 in the cable reel 102. Once the pin 222 on the distal end of the dog hole arm 218 has engaged the dog hole 118 on the cable reel 102, the dog hole tube 214 may be fixed in position by tightening the T-handle bolt 216 on the dog tube holder 212 to prevent the dog hole tube 214 from sliding further.

Figure 11:
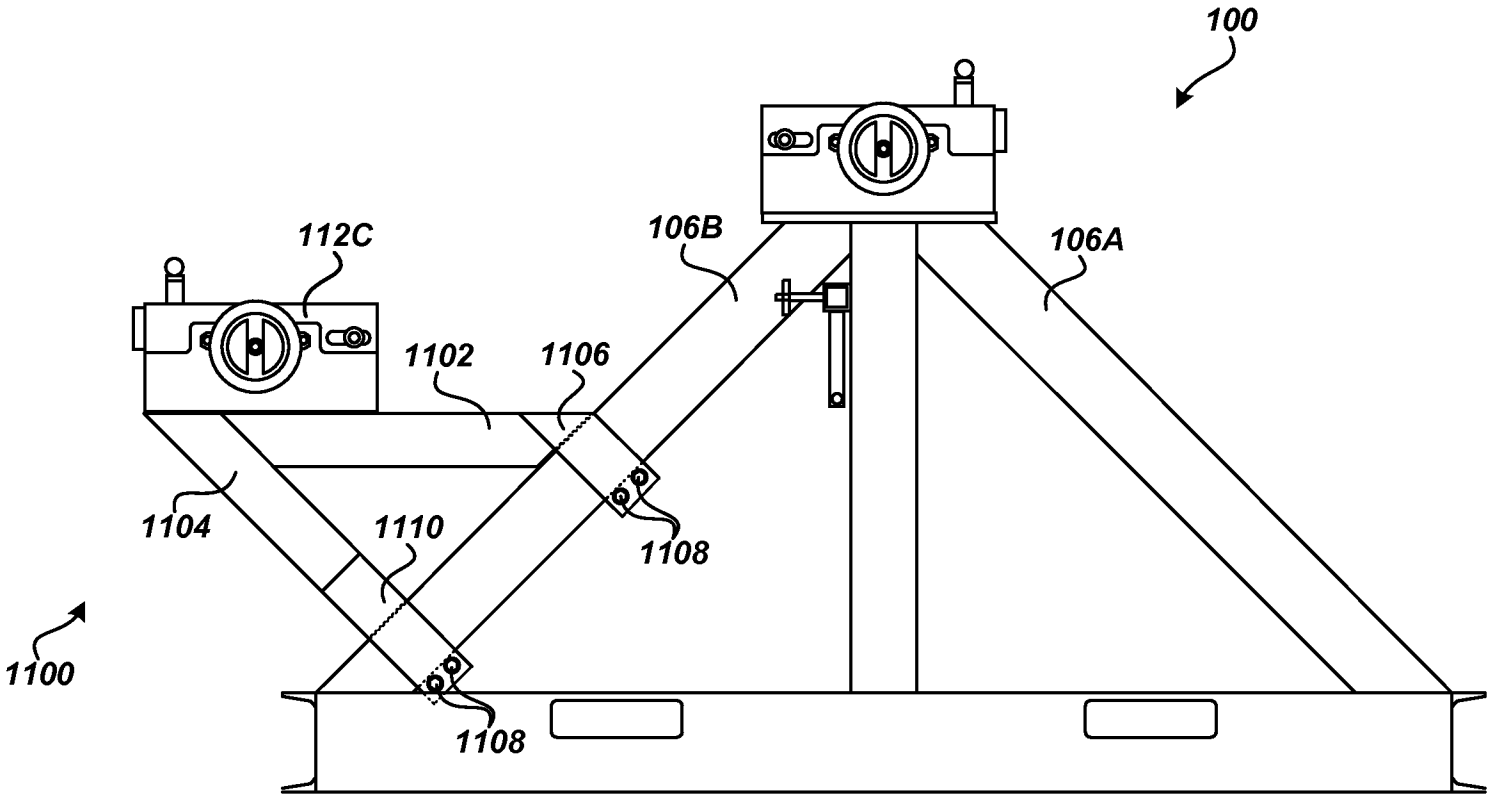
FIG. 11 is a side view of the pay-off assembly showing an illustrative ground attachment assembly attached, according to embodiments.

FIG. 11 shows an illustrative ground attachment assembly 1100 attached to the pay-off assembly 100, according to some embodiments. The ground attachment assembly 1100 may be utilized to load an additional cable reel 102 containing an additional conductor or wire for a multi-conductor pull into the pay-off assembly 100 for transport and pay-off of the cable. The ground attachment assembly 1100 may be most advantageous when a conductor of smaller or larger gauge or diameter is pulled in the multi-conductor pull, since conductors or wire of differing gauge or diameter may pay-off at a different rotational rate than the other cables in the pull. For example, if a smaller-gauged ground wire is being pulled with a multi-conductor electrical service, the multi-conductor electrical service cable may be paralleled onto one cable reel 102 and loaded into the pay-off assembly 100 described herein, while the ground wire may be loaded onto a second cable reel 102 and loaded into the ground attachment assembly 1100.

According to some embodiments, the ground attachment assembly 1100 includes a horizontal arm 1102 and a diagonal support arm 1104 welded or otherwise attached together at a proximal end. The horizontal arm 1102 and diagonal support arm 1104 may be of a same or similar width as the longitudinal braces 106 in the pay-off assembly 100. A pair of attachment plates 1106 may be welded or otherwise attached on either side of the horizontal arm 1102 at the distal end, as shown in FIG. 11. The attachment plates 1106 are configured to encompass one of the longitudinal braces 106, such as longitudinal brace 106B, of the pay-off assembly 100. The attachment plates 1106 are further attached together by one or more bolts 1108 or other fasteners passing between the attachment plates 1106 and behind the longitudinal brace 106B in order to facilitate attachment of the horizontal arm 1102 to the longitudinal brace 106B.

Similarly, a pair of attachment plates 1110 may be welded or otherwise attached on either side of the diagonal support arm 1104 at the distal end, as further shown in FIG. 11. The attachment plates 1110 are attached together by one or more bolts 1108 or other fasteners passing between the attachment plates 1110 and behind the longitudinal brace 106B in order to facilitate attachment of the diagonal support arm 1104 to the longitudinal brace 106B. A reel lock assembly 112C similar to that described herein may be further welded or otherwise attached to the proximal ends of the horizontal arm 1102 and diagonal support arm 1104 in order to hold the additional cable reel 102.

Figure 12:
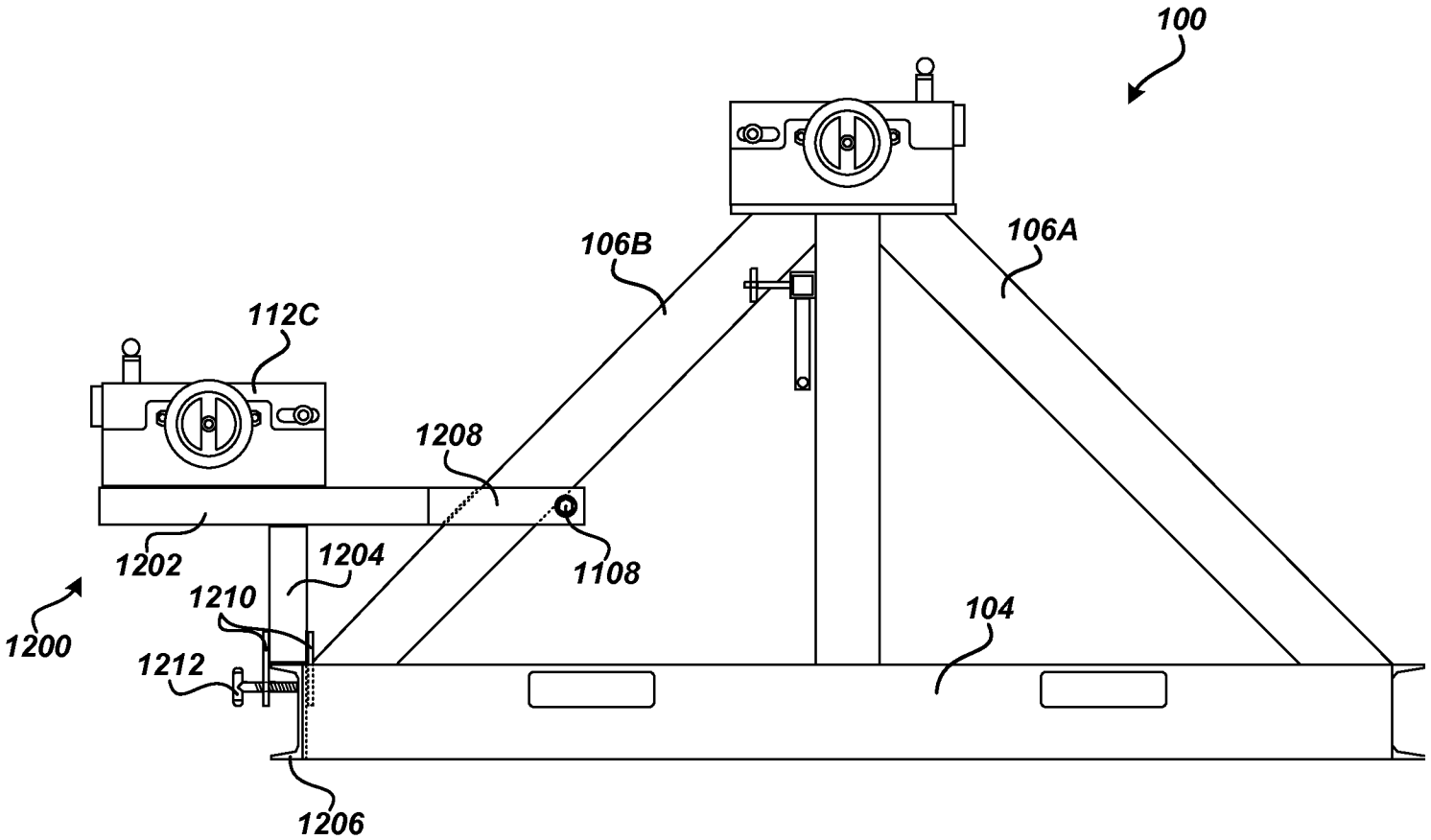
FIG. 12 is a side view of the pay-off assembly showing an illustrative ground attachment assembly attached, according to additional embodiments.

FIG. 12 shows an alternative embodiment for a ground attachment assembly 1200 attached to the pay-off assembly 100, according to some embodiments. The ground attachment assembly 1200 includes a horizontal arm 1202 and a vertical arm 1204. The vertical arm 1204 may be welded or otherwise attached to the horizontal arm 1202 near the center of the horizontal arm 1202. The horizontal arm 1202 may be of a same or similar width as the longitudinal braces 106A-106B in the pay-off assembly 100, while the vertical arm 1204 may be a same or similar width as a structural member 1206 of the base 104, such as the channel member shown in FIG. 12. As described above, a pair of attachment plates 1208 may be welded or otherwise attached on either side of the horizontal arm 1202 at one end. The attachment plates 1208 are configured to encompass one of the longitudinal braces 106, such as longitudinal brace 106B, of the pay-off assembly 100. The attachment plates 1208 are further attached together by one or more bolts 1108 or other fasteners passing between the attachment plates 1208 and behind the longitudinal brace 106B in order to facilitate attachment of the horizontal arm 1202 to the longitudinal brace 106B.

Similarly, a pair of attachment plates 1210 may be welded or otherwise attached on either side of the distal end of the vertical arm 1204, as further shown in FIG. 12. The attachment plates 1210 are configured to encompass the structural member 1206 of the base 104. A T-handle bolt 1212 may be threaded through a complementary-threaded aperture in one of the attachment plates 1210 such to engage a surface of the structural member 1206. The T-handle bold 1212 may be tightened to hold the ground attachment assembly 1200 securely in place and/or loosened for later removal of the ground attachment assembly 1200, for example. The reel lock assembly 112C may be welded or otherwise attached to the extended end of the horizontal arm 1202 in order to hold the additional cable reel 102, as further shown in the figure.

It will be appreciated that the horizontal arms 1102, 1202, diagonal support arm 1104, vertical arm 1204, and attachment plates 1106, 1110, 1208, 1210 may be fabricated from any combination of tubular members, I-beams, channels, angles, plates, and the like of any size or dimension and made from steel, aluminum, plastic, composite, or any other suitable material or combination of materials. It will be further appreciated that the ground attachment assemblies 1100, 1200 described herein are utilized in pairs in order to support the additional cable reel 102, with one ground attachment assembly 1100 attached to each longitudinal brace 106B, 106D at one end of the pay-off assembly 100. In further embodiments, two or more ground wire attachment pairs may be utilized, supporting loading of three or more cable reels 102 in the pay-off assembly 100.

Figure 13:
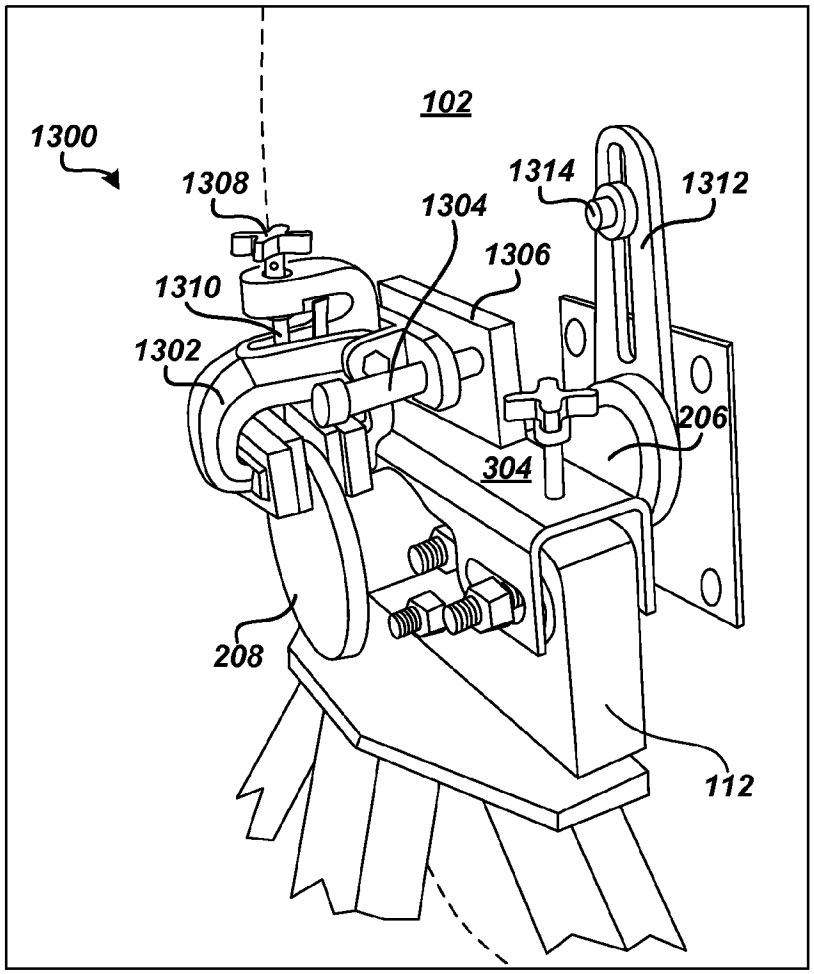
FIG. 13 is a perspective view showing details of an illustrative braking system, according to embodiments.

FIG. 13 shows an illustrative braking system 1300 attached to the pay-off assembly 100, according to some embodiments. The braking system 1300 may be utilized to control the speed of rotation of the cable reel 102 during pay-off of the cable in order to keep a requisite amount of tension in the cable during the pull and to prevent the cable reel 102 from inadvertently rotating during a pause in the pull and spilling the loaded cable. The braking system 1300 may comprise a caliper assembly 1302 that slides along a pair of caliper guide bolts 1304 attached to a caliper mount 1306. The caliper mount 1306 may be welded or otherwise attached to the reel lock top 304 of one of the reel lock assemblies 112, for example.

The brake calipers of the caliper assembly 1302 may be configured to engage the end plate 208 attached to one of the arbor tube 206 of the arbor assembly 204. The braking force of the calipers applied to the end plate 208 may be controlled by turning a knob 1308 connected to a threaded shaft 1310 to manually open and close the caliper assembly 1302. In order to ensure that the stopping force of the braking system 1300 on the end plate 208 is conveyed to the rotation of the cable reel 102, the arbor tube 206 may be connected to the cable reel 102. For example, a rotation arm 1312 may be clamped, bolted, welded, or otherwise attached to the arbor tube 206, and then attached to the cable reel 102 by one or more screws 1314, pins, bolts, or other fasteners, as further shown in FIG. 13.

Figure 15:
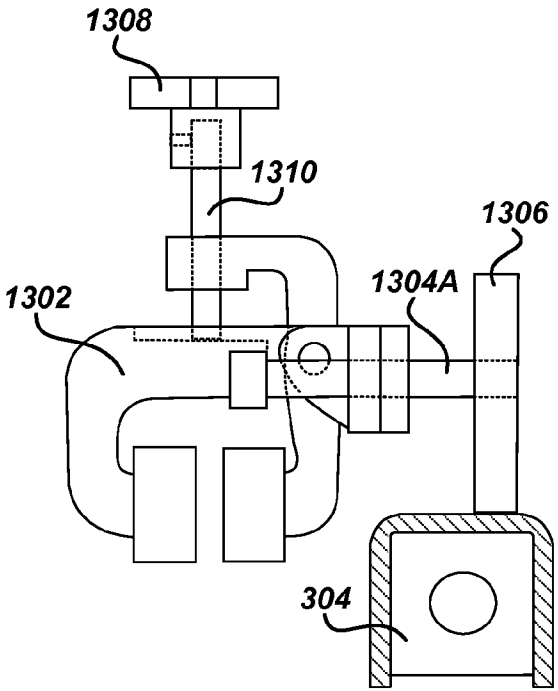
FIG. 15 is a sectional view of the reel lock top showing additional details of the braking system, according to additional embodiments.
Figure 14:
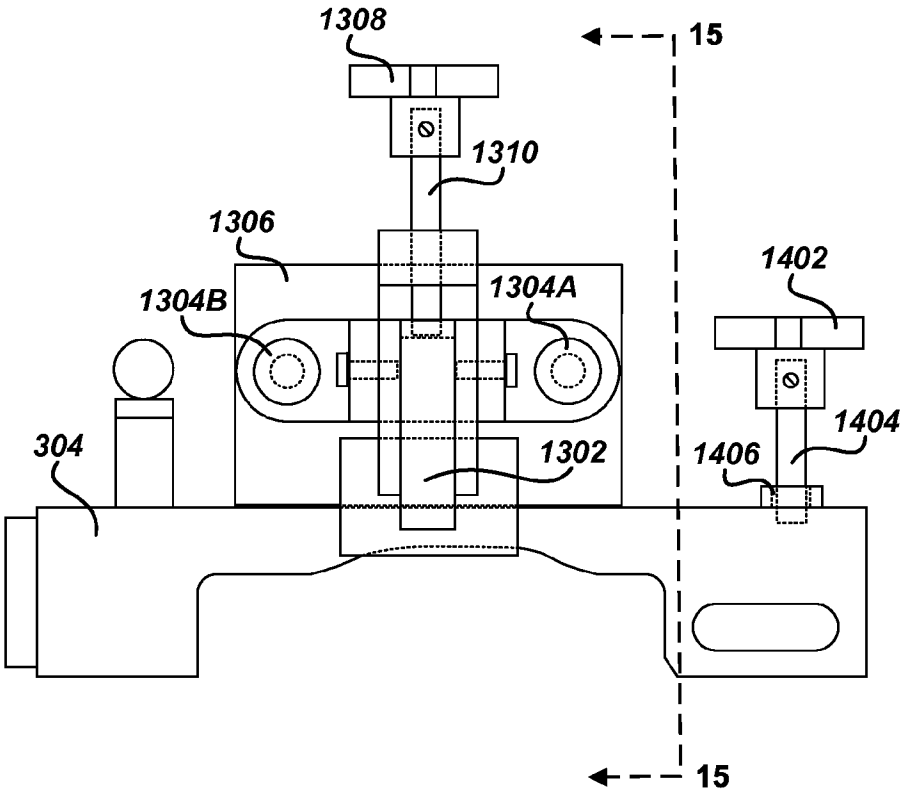
FIG. 14 is a side view of the braking system attached to a reel lock top, according to embodiments.

FIGS. 14 and 15 show additional details of the illustrative braking system 1300, according to further embodiments. As described above, the caliper mount 1306 may be welded or otherwise attached to the reel lock top 304. A pair of caliper guide bolts 1304A and 1304B extends horizontally from the caliper mount 1306. The caliper assembly 1302 slides along the caliper guide bolts 1304A and 1304B in order to engage the end plate 208 attached to one end of the arbor tube 206. The caliper assembly 1302 may further be configured to slide along the caliper guide bolts 1304A and 1304B in order to adjust with the arbor tube 206 and end plate 208 if the position of the arbor assembly 204 shifts during pay-off of the cable.

The knob 1308 may be connected to the threaded shaft 1310 by a set screw, pin, or other attachment means. The braking force may be applied to the calipers by turning the knob 1308 and threaded shaft 1310 in order to manually open and close the caliper assembly 1302. In additional embodiments, a knob 1402 and threaded shaft 1404 may pass through a complementary-threaded aperture 1406 on the top surface of the reel lock top 304, as further shown in FIG. 14. When the reel lock assembly 112 is closed, turning the knob 1402 and the threaded shaft 1404 such that an end of the threaded shaft 1404 firmly engages a top surface of the reel lock bottom 302 may prevent movement and/or vibration of the reel lock top 304 during transport of the cable reel 102 and pay-off of the cable.

It will be appreciated that an improved pay-off assembly 100 may incorporate some or all of the elements and components described above. In addition, the improved pay-off assembly 100 may incorporate other elements and components beyond those described above. The subject matter described above is provided by way of illustration only and should not be construed as limiting. Various modifications and changes may be made to the subject matter described herein without following the example embodiments and applications illustrated and described, and without departing from the true spirit and scope of the present invention.

What is claimed is:

1. A pay-off assembly for transporting a cable reel and supporting the cable reel during pay-off of a cable loaded on the cable reel, the pay-off assembly comprising:

an A-frame structure for supporting the cable reel, the A-frame structure comprising a pair of longitudinal braces attached at a bottom to a base and at a top to a top plate, the A-frame structure further comprising a lateral support brace attached between the base and the top plate; and a reel lock assembly attached to the top plate, the reel lock assembly comprising:

a reel lock bottom comprising a U-shaped indentation, and a reel lock top comprising a first sidewall and a second sidewall, the first sidewall and the second sidewall defining a channel sized to receive the reel lock bottom, the reel lock top arranged such that a portion of the first sidewall and a portion of the second sidewall extend below a top surface of the reel lock bottom and engage the reel lock bottom when the reel lock top is in a closed position, wherein the reel lock top, when transitioned into the closed position over at least a portion of the U-shaped indentation of the reel lock bottom, slides from a first horizontal position in relation to the reel lock bottom to a second horizontal position in relation to the reel lock bottom.

2. The pay-off assembly of claim 1, wherein the reel lock bottom further comprises a pin at a distal end of the reel lock bottom and the reel lock top comprises an aperture at a distal end of the reel lock top corresponding to the pin, the aperture configured to receive a first portion of the pin on the reel lock bottom when the reel lock top is in the first horizontal position and a second portion of the pin on the reel lock bottom when the reel lock top is in the second horizontal position, wherein the second portion of the pin is greater than the first portion of the pin.

3. The pay-off assembly of claim 1, wherein the reel lock top further comprises a pull-pin and the reel lock bottom comprises a corresponding aperture that receives the pull-pin when the reel lock top is slid horizontally along the reel lock bottom from the first horizontal position to the second horizontal position.

4. The pay-off assembly of claim 1, wherein the reel lock bottom further comprises a plurality of track rollers located within the U-shaped indentation and arranged to receive at least a portion of an arbor tube of an arbor assembly and to allow the arbor tube to freely rotate when received within the U-shaped indentation of the reel lock bottom.

5. The pay-off assembly of claim 1, further comprising an arbor assembly comprising an arbor tube and a removable end-cap assembly, the removable end-cap assembly comprising an end cap and a hand-wheel with a threaded extension configured to be attached by hand to an end of the arbor tube and to prevent the end cap and the hand-wheel from counter-rotating and becoming unattached during rotation of the arbor tube.

6. The pay-off assembly of claim 5, wherein the end cap comprises a pin configured to engage a corresponding aperture in a plug in the end of the arbor tube in order to prevent the end cap and the hand-wheel from counter-rotating during rotation of the arbor tube.

7. The pay-off assembly of claim 1, further comprising a braking system comprising a brake caliper assembly slidedly engaging one or more caliper guide bolts, the one or more caliper guide bolts extending from a caliper mount, wherein the brake caliper assembly is configured to engage an end plate attached to an arbor tube of an arbor assembly when at least a portion of the arbor tube is received within the U-shaped indentation of the reel lock bottom and to apply braking pressure to the end plate to control a rotational speed of the arbor tube.

8. The pay-off assembly of claim 7, where the braking pressure to the end plate is applied by turning a knob attached to a threaded extension to manually open and close the brake caliper assembly.

9. The pay-off assembly of claim 1, wherein the reel lock top comprises a slot at a proximal end of the reel lock top, the reel lock bottom further comprises a corresponding aperture at a proximal end of the reel lock bottom, and the reel lock assembly further comprises a fastener that passes through the slot at the proximal end of the reel lock top and through the corresponding aperture at the proximal end of the reel lock bottom to attach the reel lock top to the reel lock bottom.

10. The pay-off assembly of claim 1, further comprising a plurality of shaft collars, each of the plurality of shaft collars comprising two halves attached together by one or more lanyards.

11. The pay-off assembly of claim 1, further comprising a dog hole stop assembly comprising a dog hole tube and a dog hole arm, the dog hole tube slidedly-engaging a dog tube holder and configured to be extended towards and retracted away from the cable reel, the dog hole arm configured to pivot around a proximal end attached to the dog hole tube and having a pin at a distal end configured to engage a dog hole on the cable reel.

12. The pay-off assembly of claim 1, further comprising a ground attachment assembly attached to one of the pair of longitudinal braces and configured to hold an additional cable reel for transport and pay-off of an additional cable, the ground attachment assembly comprising an additional reel lock assembly for receiving an additional arbor assembly supporting the additional cable reel.

13. The pay-off assembly of claim 1, wherein the base comprises one or more fork pocket channels positioned to allow for the pay-off assembly to be lifted by a forklift truck.

14. A system for transporting a cable reel and supporting the cable reel during pay-off of a cable loaded on the cable reel, the system comprising:

a base;

an A-frame structure comprising a pair of longitudinal braces attached at a bottom to the base and at a top to a top plate, the A-frame structure further comprising a lateral support brace attached between the top plate and the base and running diagonally from the top plate down towards an outer edge of the base;

an arbor assembly comprising an arbor tube for supporting the cable reel, and a removable end-cap assembly; and a reel lock assembly attached to the top plate, the reel lock assembly comprising:

a reel lock bottom comprising a U-shaped indentation arranged to receive at least a portion of the arbor tube of the arbor assembly, and a reel lock top comprising a first sidewall and a second sidewall, the first sidewall and the second sidewall defining a channel sized to receive the reel lock bottom, the reel lock top arranged such that a portion of the first sidewall and a portion of the second sidewall extend below a top surface of the reel lock bottom when the reel lock top is in a closed position, the reel lock top attached to the reel lock bottom by a fastener that acts as a hinge such that the reel lock top may be opened to receive the at least a portion of the arbor tube of the arbor assembly and closed to secure the arbor tube in place, the reel lock top, when being transitioned to the closed position, slides from a first horizontal position in relation to the reel lock bottom to a second horizontal position in relation to the reel lock bottom.

15. The system of claim 14, wherein the reel lock bottom further comprises a pin at a distal end of the reel lock bottom and the reel lock top comprises an aperture at a distal end of the reel lock top corresponding to the pin, the aperture configured to receive a first portion of the pin on the reel lock bottom when the reel lock top is in the first horizontal position and a second portion of the pin, greater than the first portion, when the reel lock top is in the second horizontal position, and wherein the reel lock top comprises a pull-pin and the reel lock bottom further comprises a corresponding aperture that receives the pull-pin when the reel lock top is slid horizontally along the reel lock bottom from the first horizontal position to the second horizontal position.

16. The system of claim 14, wherein the removable end-cap assembly comprises an end cap having a pin and a hand-wheel having a threaded extension, wherein the pin is configured to engage a corresponding aperture in a plug in an end of the arbor tube when the removable end-cap assembly is attached to the arbor tube to prevent the end cap and the hand-wheel from counter-rotating and becoming unattached during rotation of the arbor tube.

17. The system of claim 14, further comprising a braking system comprising a brake caliper assembly configured to engage an end plate attached to the arbor tube and to apply braking pressure to the end plate to control a rotational speed of the arbor tube.

18. The system of claim 14, further comprising a dog hole stop assembly comprising a dog hole tube and a dog hole arm, the dog hole tube slidedly engaging a dog tube holder and configured to be extended towards and retracted away from the cable reel, the dog hole arm configured to pivot around a proximal end attached to the dog hole tube and having a pin at a distal end configured to engage a dog hole on the cable reel.

19. The system of claim 14, further comprising a ground attachment assembly attached to one of the pair of longitudinal braces and configured to hold an additional cable reel for transport and pay-off of an additional cable, the ground attachment assembly comprising an additional reel lock assembly for receiving an additional arbor tube supporting the additional cable reel.

20. A pay-off assembly comprising:

a base;

an A-frame structure comprising a pair of longitudinal braces attached at a bottom to the base and at a top to a top plate; and a reel lock assembly attached to the top plate, the reel lock assembly comprising;

a reel lock bottom comprising a U-shaped indentation arranged to receive at least a portion of an arbor tube, and a reel lock top comprising a first sidewall and a second sidewall, the first sidewall and the second sidewall defining a channel sized to receive the reel lock bottom, the reel lock top arranged such that a portion of the first sidewall and a portion of the second sidewall extend below a top surface of the reel lock bottom when the reel lock top is in a closed position, the reel lock top attached to the reel lock bottom by a fastener that acts as a hinge such that the reel lock top may be opened to receive the at least a portion of the arbor tube and closed to secure the arbor tube in place, and the reel lock top, when being transitioned to the closed position, slides from a first horizontal position in relation to the reel lock bottom to a second horizontal position in relation to the reel lock bottom.

21. The pay-off assembly of claim 20, wherein the reel lock bottom further comprises a pin at a distal end of the reel lock bottom and the reel lock top comprises a corresponding aperture at a distal end of the reel lock top configured to receive a first portion of the pin on the reel lock bottom when the reel lock top is in the first horizontal position and to receive a second portion of the pin, greater than the first portion, when the reel lock top is in the second horizontal position.

22. The pay-off assembly of claim 20, further comprising lateral support braces attached between the top plate and the base and running diagonally from the top plate down towards an outer edge of the base.

23. The pay-off assembly of claim 20, wherein the reel lock bottom comprises a plurality of track rollers located within the U-shaped indentation to support the arbor tube.

24. The pay-off assembly of claim 20, further comprising a braking system attached to the reel lock top and comprising a brake caliper assembly configured to engage an end plate attached to the arbor tube and to apply braking pressure to the end plate to control a rotational speed of the arbor tube.

25. The pay-off assembly of claim 24, wherein the braking pressure is applied to the end plate by turning a knob attached to a threaded extension to manually open and close the brake caliper assembly.

26. The pay-off assembly of claim 20, further comprising a ground attachment assembly attached to one of the pair of longitudinal braces and comprising a second reel lock assembly for receiving a second arbor tube supporting an additional cable reel.

* * * * *